United States Patent [19]
James et al.
[11] 4,220,445
[45] Sep. 2, 1980

[54] FLUID BED FURNACE AND COVER ASSEMBLY FOR USE THEREON

[75] Inventors: William L. James, Homewood; Hans J. Staudenmaier, Glendale, both of Ill.

[73] Assignee: Fennell Corporation, Harvey, Ill.

[21] Appl. No.: 958,140

[22] Filed: Nov. 6, 1978

[51] Int. Cl.[2] ..... F27D 1/18; F27B 15/00
[52] U.S. Cl. ..... 432/250; 34/57 A; 110/216; 110/245; 432/58; 432/197
[58] Field of Search ..... 34/57 A; 159/DIG. 3; 110/245, 216; 432/58, 197, 249, 250

[56] References Cited

U.S. PATENT DOCUMENTS

| | | | |
|---|---|---|---|
| 1,776,128 | 9/1930 | Otis | 432/197 |
| 2,932,498 | 4/1960 | Metcalfe et al. | 432/58 |
| 3,397,873 | 8/1968 | Ritchie et al. | 34/57 A |
| 3,399,874 | 9/1968 | Ritchie | 432/197 |
| 3,884,617 | 5/1975 | Virr | 432/58 |

*Primary Examiner*—John J. Camby
*Attorney, Agent, or Firm*—Trexler, Wolters, Bushnell & Fosse, Ltd.

[57] ABSTRACT

The disclosure relates to an improved fluid bed furnace which includes a new and improved cover assembly and which is of the type including a fluid bed including a material which fluidizes upon being subjected to a flow of a gas mixture therethrough and a burner for distributing a gas mixture at an elevated temperature through the fluid bed material for fluidizing and agitating the fluid bed material. The cover assembly provides both exhaustion of the heated gas mixture from the furnace fluid bed and confinement of the agitated fluid bed material within the fluid bed. The cover assembly includes a hollow cap member having a bottom, a top, and an inner wall surface, a first aperture in the bottom communicating with the furnace fluid bed, and a second aperture in the top, and baffle means disposed within the hollow cap member between the first and second apertures and having an outer periphery spaced from the cap member inner wall surface but which is greater in dimension than the second aperture forming a space between the baffle means periphery and the cap member inner wall surface for exhausting the heated gas mixture from the fluid bed and forming a barrier for trapping the agitated fluid bed material within the fluid bed.

17 Claims, 3 Drawing Figures

FLUID BED FURNACE AND COVER ASSEMBLY FOR USE THEREON

BACKGROUND OF THE INVENTION

The present invention is directed generally to an improved fluid bed furnace and more particularly to a new and improved cover assembly for use in a fluid bed furnace.

Furnaces for heat-treating metal components or the like are well known. Such furnaces have included a heated bath taking the form of molten salt or lead. The molten salt or lead is heated to an elevated temperature and the metal components to be treated are emersed therein, whereupon, the heat of the baths is transferred to the metal components for treatment.

Such furnaces, while being generally successful in heat-treating metal components or the like, have exhibited certain difficulties. For example, molten salt is hazardous when employed because it is potentially explosive should water come into contact with the heated salt. The salt may be heated to a temperature of, for example, 1400°-2000° F., which, upon contacting water, will explode. Hence, a great deal of care is necessary when employing such a furnace to make sure that water does not come into contact with the molten salt.

In the case of molten lead baths, molten lead is extremely acidic in nature, and hence, it is difficult to use in terms of finding a suitable container in which to confine the molten lead. Furthermore, molten lead and salt are wetting materials which, as a result, wet the metallic components being heat treated. As a result, some means must be provided for removing the molten lead or salt bath materials from the components subsequent to being treated.

In view of the foregoing, a furnace for heat-treating metal components or the like has been proposed which does not include salt or lead baths. In contrast, this type of furnace utilizes fluidizable material which may take the form of corrundum or silica particles. One material which becomes fluidized upon being subjected to a flow of gas and which has become popular for such use is sand.

Such furnaces have become known as fluid bed furnaces, and one such furnace is fully described in U.S. Pat. No. 3,884,617, which patent is incorporated herein by reference. The fluid bed furnace there disclosed includes a fluid bed which includes fluidizable material, such as particulate sand. A burner disposed beneath the fluid bed distributes a heated gas mixture to the fluidizable material within the fluid bed for fluidizing and agitating the fluid bed particles. As a result, the heat of the gas mixture is transferred to the fluidizable material and the heat of the fluidizable material is in turn transferred to metallic components placed therein for heat treatment.

Agitation of the fluidized material particles provides for continuous mixing of the particles and continuous particle flow within the fluid bed for obtaining heat from the gas mixture. Fluid bed furnaces have become attractive for heat treating metallic components because the fluidizable material is inert and non-explosive when contacting water. Furthermore, due to the inert nature of the fluidizable material, the fluidizable material does not attack the walls of the container in which they are held. Lastly, the fluidizable material is non-wetting, negating the need for treating the heat-treated components for removal of the fluidizable material thereform.

With the extreme agitation that may occur in such fluid bed furnaces, and because the heated gas mixture must be exhausted from the furnace fluid bed, some means must be provided for both exhausting the gas mixture from the fluid bed and for trapping the fluidizable material particles within the fluid bed during use. Such a means must further enable metallic components to be readily placed into the fluid bed and emersed within the fluidizable material.

It is therefore a general object of the present invention to provide a new and improved fluid bed furnace which includes a new and improved cover assembly which provides exhaustion of the heated gas mixture from the fluid bed and entrapment of the fluidizable material particles within the fluid bed.

It is a more particular object of the present invention to provide a new and improved cover assembly for use in a fluid bed furnace which not only provides for the exhaustion of the gas mixture from the fluid bed and the entrapment of the fluidizable material particles within the fluid bed, but additionally, affords the ready placement of the metal components within the fluid bed for emersion into the fluidizable material.

SUMMARY OF THE INVENTION

The invention therefore provides a cover assembly for use in a fluid bed furnace of a type including a fluid bed having a material which fluidizes upon being subjected to a sufficient flow of gas and means for distributing a gas mixture at an elevated temperature through the fluid bed material for fluidizing and agitating the fluid bed material. The cover assembly provides both exhaustion of the heated gas mixture from the furnace fluid bed and confinement of the agitated fluid bed material particles within the fluid bed. The cover assembly includes a hollow cap means having a bottom, a top, and an inner wall surface, a first aperture in the bottom communicating with the furnace fluid bed, and a second aperture in the top, and baffle means disposed within the hollow cap means between the first and second apertures and having an outer periphery spaced from the cap means inner wall surface and greater in dimension than the second aperture forming a space between the baffle means periphery and the cap means inner wall surface for exhausting the heated gas mixture from the fluid bed and forming a barrier for trapping the agitated fluid bed material particles within the fluid bed.

The invention further provides a fluid bed furnace which includes a fluid bed containing a material which fluidizes upon being subject to a sufficient flow of gas, means for distributing a gas mixture at an elevated temperature through the fluid bed material for fluidizing and agitating the fluid bed material, and a cover assembly including a hollow cap means having a bottom, a top, and an inner wall surface, a first aperture in the bottom communicating with the furnace fluid bed, and a second aperture in the top, and baffle means disposed within the hollow cap means between the first and second apertures and having an outer periphery spaced from the cap means inner wall surface and greater in dimension than said second aperture forming a space between the baffle means periphery and the cap means inner wall surface through which the heated gas mixture is exhausted from the fluid bed and forming a barrier for trapping the agitated fluid bed material within the fluid bed.

In order to provide for the placement of components to be heat treated into the furnace fluid bed, the cover assembly is further pivotally mounted to the furnace fluid bed for pivoting relative thereto to afford the ready placement of components to be heat-treated into the fluid bed and emersed into the fluidizable material.

BRIEF DESCRIPTION OF THE DRAWINGS

The features of the present invention which are believed to be novel are set forth with particularity in the appended claims. The invention, together with further objects and advantages thereof, may best be understood by reference to the following description taken in connection with the accompanying drawings, in the several figures of which like reference numerals identify like elements, and in which:

DESCRIPTION OF THE PREFERRED EMBODIMENT

Figure 1:
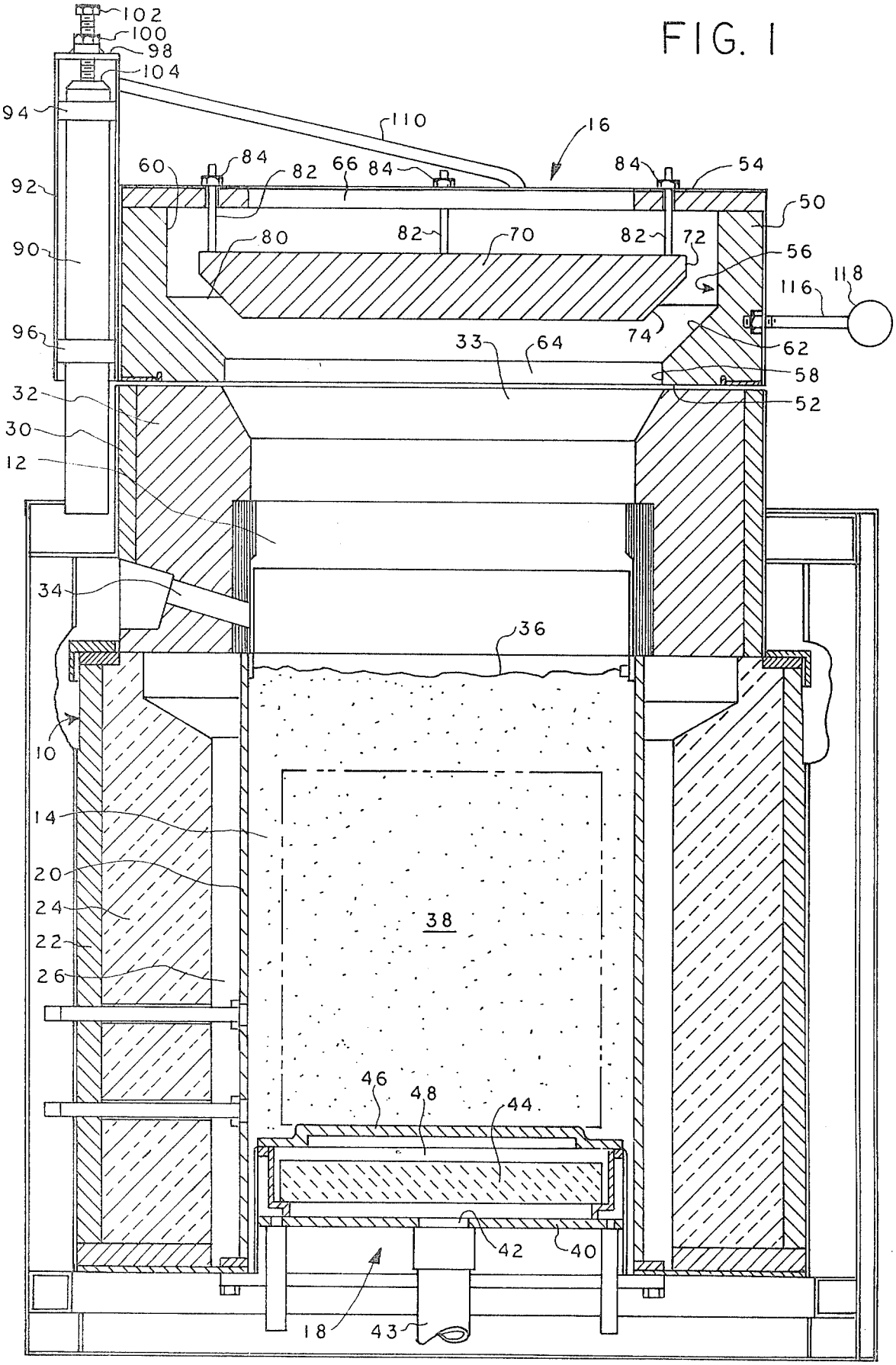
FIG. 1 is a cross-sectional view of a fluid bed furnace embodying the present invention.

Referring now to FIG. 1, the fluid bed furnace thereshown generally includes a fluid bed 10 including an upper portion 12 and a lower portion 14, a cover assembly 16 embodying the present invention, and a burner assembly 18.

The fluid bed lower portion 14 is cylindrical in configuration and is formed by a pair of co-axially disposed annularly spaced walls 20 and 22. Between the walls 20 and 22 there is provided annular insulation 24 and an annular cooling chamber 26.

The upper fluid bed portion 12 is also generally cylindrical in configuration and includes an outer cylindrical wall portion 30 and insulation 32. Extending through the wall 30 and insulation 32 is a through bore 34 in which a pilot light may be disposed for igniting the fluid bed furnace.

Within the lower fluid bed portion 14 is a fluidizable material 38 which may be, for example, particulate sand. The sand 38 is administered to the fluid bed lower portion 14 to a level indicated at 36.

For fluidizing and agitating the sand 38, the burner assembly 18 is provided beneath the fluid bed 14. The burner assembly includes a bottom plate 40 having a center aperture 42 which communicates with a conduit 43 through which a fuel gas mixture is administered to the burner assembly. Above the plate 40 is disposed a porous ceramic plate 44 which allows the gas fuel mixture to pass therethrough. Above the porous ceramic plate is disposed a metallic grid 46 which includes a plurality of tiny through apertures. The through apertures are so small that the particulate sand 38 is not allowed to seep therethrough into the space 48 between the grid 46 and the porous ceramic plate 44.

When igniting the furnace of FIG. 1, the pilot assembly is ignited to provide a pilot flame. Then, the gas fuel mixture is administered to the burner assembly 18 through the conduit 43 and allowed to pass through the porous ceramic plate 44, the grid 46, and the particulate sand 38 to the vicinity of the pilot lamp (not shown) disposed within the bore 34. The fuel mixture is then ignited. After the gas fuel within the fluid bed has been fully combusted, the flame of the burner assembly 18 will be generally confined between the grid 46 and the porous ceramic tile 44. The burning of the gas fuel by the burner assembly 18 results in the distributed flow of a heated gas mixture through the particulate sand 38. The particulate sand then fluidizes and is agitated for circulation within the fluid bed lower portion 14. Because the sand 38 may be subjected to a vigorous flow of the gas mixture, the sand is caused to be greatly agitated to the point where the sand particles may inadvertently escape through the opening 33 of the fluid bed upper portion 12. In order to entrap the agitated sand particles within the fluid bed and to exhaust the gas mixture distributed through the sand 38, the new and improved cover assembly 16 is provided.

The cover assembly 16 includes a cap means 50 which takes the form of a hollow cylindrical member having a bottom 52, a top 54, and an annular inner surface 56. The annular inner surface 56 includes a first cylindrical inner surface portion 58, a second cylindrical inner surface portion 60, and an inclined annular surface portion 62 which integrally joins the cylindrical surface portions 58 and 60. The inclined inner annular surface portion 62 diverges in a direction from the bottom 52 of the cap member 50 to the top 54 of the cap member 50.

The cap member 50 further includes a first circular aperture 64 defined by the cylindrical annular surface portion 58, which aperture 64 communicates with the opening 33 of the fluid bed upper portion 12. The cap member 50 also has a second circular aperture 66 at the top 54 thereof.

Coaxially disposed within the cap member 50 is a baffle 70 which is also generally cylindrical in configuration. The baffle 70 has an outer periphery defined by a cylindrical surface 72 and has an outer annular inclined surface 74. The inclined surface 74 diverges in substantially parallel correspondence to the inclined surface 62 of the cap member 50. As can be seen from the drawing, the baffle 70 has a lesser diameter dimension than the inner diameter dimension of the cap member 50 to form an annular space 80. The baffle 70 is also of greater diameter dimension than the second aperture 66. Lastly, the baffle 70 is coaxially disposed within the cap member 50 by a plurality of rods 82 and threadingly engaged knots 84.

When the furnace is in operation, the heated gas mixture is exhausted from the furnace fluid bed through the annular space 80 between the inner surface of the cap member 50 and the outer surface of the baffle 70. Not only does the baffle 70 provide exhaustion of the heated gas mixture, but also, entraps the agitated sand particles within the fluid bed. More specifically, because the baffle 70 has a diameter dimension greater than the second aperture 66 in the top of the cap member 50, it will present a barrier to sand particles which are overagitated and which would otherwise be thrown from the fluid bed. The inclined surfaces 74 and 62 provide assistance to this end in as much as the annular space 80 extends radially outwardly with respect to the dimension of the first aperture 64 defined by the cylindrical surface 58.

Figure 2:
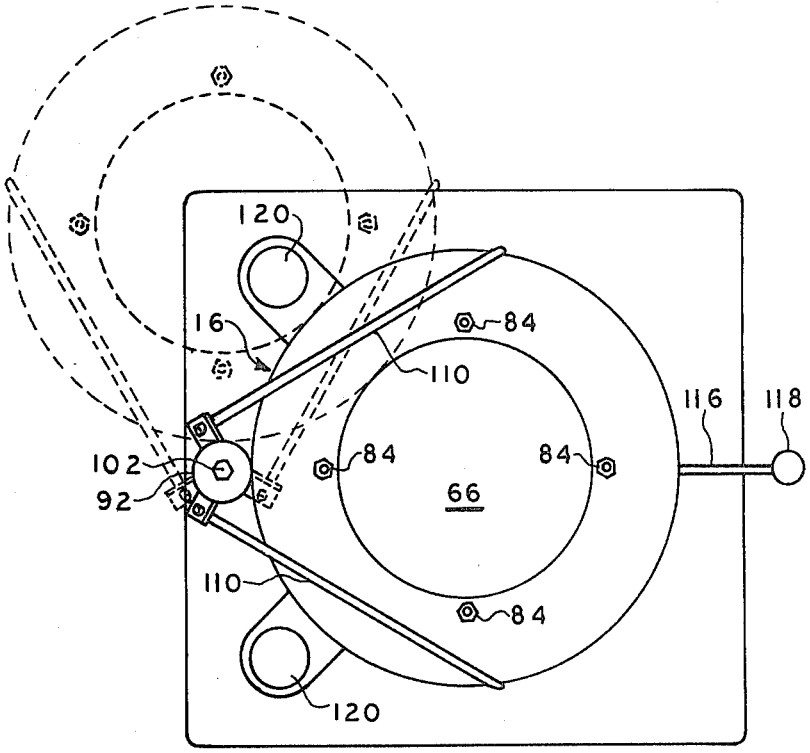
FIG. 2 is a top view of the fluid bed furnace of FIG. 1.
Figure 3:
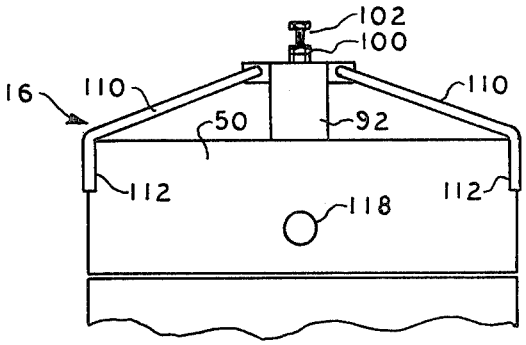
FIG. 3 is a partial side elevational view of the fluid bed furnace of FIG. 1.

The cover assembly 16 is pivotally connected to the furnace fluid bed so that it may be pivoted out of the way to afford the placement of metallic components or the like to be treated into the fluid bed and emersed within the sand 38. To that end, as can be seen in FIGS. 1, 2, and 3, the furnace includes a cylindrical column 90 which extends vertically upwardly and which is fixedly mounted to the outer periphery of the fluid bed upper portion 12. The cap member 50 carries at its outer periphery a hollow cylindrical member 92 which is greater in dimension than the cylindrical column 90. The cylindrical member 92 receives the cylindrical column 90 therein and makes bearing surface engagement with bearing rings 94 and 96. The cylindrical member 92 has a top portion 98 which carries a first threaded member 100 and which receives a second threaded member 102. The threaded member 102 extends through the threaded member 100 and engages the top surface 104 of the column 90. This structure provides an adjustment for adjusting the spacing between the bottom 52 of the cap member 50 and the top of the fluid bed upper portion 52. The spacing therebetween affords clearance for the pivotal movement of the cover assembly 16 relative to the furnace fluid bed.

As can be seen in FIG. 2, the cylindrical member 92 is provided with a pair of strut members 110 which extend substantially across the cap member 50 and are fixed thereto along external side portions 112. As also can be seen in the figures, the cap member 50 is provided with a handle extension 116 which has an end knob 118 which may be grasped by an operator for pivoting the cover assembly 16 relative to the furnace fluid bed. In FIG. 2, the cover assembly 16 is shown in a closed position relative to the furnace fluid bed by solid lines, and is shown in an open position relative thereto in phantom.

Also seen in FIG. 2 are a pair of ducts 120, which communicate with a cooling system (not shown) for the furnace which presents an artificial load to the furnace when the furnace is presented with a relatively light load. The ducts 120 therefore permit the furnace to be maintained at its proper operating conditions without causing excessive agitation to the fluidizable material when under small work loads.

From the foregoing, it can be seen that the present invention provides a new and improved fluid bed furnace. The cover assembly of the present invention provides for both the exhaustion of the heated gas mixture from the furnace fluid bed and the entrapment of the agitated fluidizable material particles within the fluid bed. The cover assembly and furnace of the present invention also provides for the ready placement of components to be heat treated into the fluid bed and emersed into the fluidizable material through the pivotal action of the cover assembly relative to the furnace fluid bed.

While a particular embodiment of the present invention has been shown and described, modifications may be made, and it is therefore intended to cover in the appended claims all such changes and modifications which fall within the true spirit and scope of the invention.

The invention is claimed as follows:

1. A cover assembly for use in a fluid bed furnace of the type including a fluid bed having a material which fluidizes upon being subjected to a sufficient flow of gas and means for distributing a gas mixture at an elevated temperature through the fluid bed material for fluidizing and agitating the fluid bed material, said cover assembly providing both exhaustion of the heated gas mixture from the furnace and confinement of the agitated fluid bed material within the fluid bed comprising: hollow cap means having a bottom, a top, and an inner wall surface, a first aperture in said bottom communicating with the furnace fluid bed, and a second aperture in said top; and baffle means disposed within said hollow cap means between said first and second apertures and having an outer periphery spaced from said cap means inner wall surface and greater in dimension than said second aperture forming a space between said baffle means periphery and said cap means inner wall surface through which the heated gas mixture is exhausted from the fluid bed and forming a barrier for trapping the agitated fluid bed material within the fluid bed.

2. A cover assembly as defined in claim 1 wherein said cap means further includes pivot means hingedly connecting said cap means to said furnace to allow said cap means to be radially displaced about said pivot means to afford the place ment of components to be heat treated into the furnace fluid bed.

3. A cover assembly as defined in claim 2 wherein said cap means bottom is slightly spaced from the furnace to provide clearance for the pivoting of said cap means relative thereto.

4. A cover assembly as defined in claim 1 wherein said cap inner wall surface includes an inclined inner surface portion and wherein said baffle means outer periphery includes an outer surface portion inclined in correspondence to said cap means inclined inner surface portion.

5. A cover assembly as defined in claim 4 wherein the fluid bed is generally cylindrical in shape, wherein said cap means is correspondingly cylindrical in shape, wherein said cap means inner surface and said baffle means outer surface form annular surfaces and wherein said space between said cap means inner surface and said baffle means outer periphery comprises an annular passage for the exhaustion of the heated gas mixture.

6. A cover assembly for use in a fluid bed furnace of the type which includes a fluid bed containing particulate material which fluidizes upon being subject to flowing gases and means for distributing a heated gas mixture through the fluid bed for fluidizing and agitating the fluid bed material, said cover assembly providing both exhaustion of the heated gas mixture from the furnace and entrapment of the agitated fluid bed particles within the fluid bed comprising: a hollow cylindrical cap member having a bottom, a top, and an inner annular surface, a first circular aperture in said bottom communicating with the furnace fluid bed, and a second circular aperture in said top; and a cylindrical baffle member co-axially disposed within said cap member between said first and second apertures and having a smaller diameter dimension than said cap inner annular surface but greater in diameter dimension than said second aperture forming an annular space through which the heated gas mixture is exhausted from the fluid bed and forming a barrier for trapping the agitated fluidized particles within the fluid bed.

7. A cover assembly as defined in claim 6 wherein said cap inner annular surface includes a diverging surface portion diverging from said bottom to said top, and wherein said baffle member includes an outer annular surface diverging in substantially parallel correspondence with said cap member diverging inner surface portion.

8. A fluid bed furnace comprising a fluid bed including a material which fluidizes upon being subjected to a sufficient flow of gas; means for distributing a gas mixture at an elevated temperature through the fluid bed material for fluidizing and agitating the fluid bed material; and a cover assembly including a hollow cap means having a bottom, a top, and an inner wall surface, a first aperture in said bottom communicating with the furnace fluid bed, and a second aperture in said top, and baffle means disposed within said hollow cap means between said first and second apertures and having an outer periphery spaced from said cap means inner wall surface and greater in dimension than said second aperture forming a space between said baffle means periphery and said cap means inner wall surface through which the gas mixture is exhausted from the fluid bed and forming a barrier for trapping the agitated fluid bed material within said fluid bed.

9. A fluid bed furnace as defined in claim 8 wherein said cap means and said fluid bed are hingedly connected for pivoting said cap means relative to said fluid bed to afford the placement of components to be heat treated into said fluid bed.

10. A fluid bed furnace as defined in claim 9 wherein said cap means bottom is slightly spaced from the fluid bed to provide clearance for pivoting of said cap means relative thereto.

11. A fluid bed furnace as defined in claim 8 wherein said cap inner wall surface includes an inclined inner surface portion and wherein said baffle means outer periphery includes an outer surface portion inclined in correspondence to said cap means inclined inner surface portion.

12. A fluid bed furnace as defined in claim 11 wherein said fluid bed is generally cylindrical in shape, wherein said cap means is correspondingly cylindrical in shape, wherein said cap means inner surface and said baffle means outer surface form annular surfaces and wherein said space between said cap means inner surface and said baffle means outer periphery comprise an annular passage for the exhaustion of heated gas mixture.

13. A fluid bed furnace comprising a fluid bed containing particulate material which fluidizes upon being subjected to fluidizing gases; means for distributing a heated gas mixture through said fluid bed for fluidizing and agitating the fluid bed particulate material; and a cover assembly including a hollow cylindrical cap member having a bottom, a top, and an inner annular surface, a first circular aperture in said bottom communicating with said fluid bed, and a second circular aperture in said top, and a cylindrical baffle member co-axially disposed within said cap member between said first and second apertures and having a smaller diameter dimension than said cap inner annular surface but greater in diameter dimension than said second aperture forming an annular space for exhausting the heated gas mixture from said fluid bed and forming a barrier for trapping the agitated fluidized particles within said fluid bed.

14. A fluid bed furnace as defined in claim 13 wherein said cap inner annular surface includes a diverging surface portion diverging from said bottom to said top, and wherein said baffle member includes an outer annular surface diverging in substantially parallel correspondence with said cap member diverging inner surface portion.

15. A fluid bed furnace as defined in claim 14 further comprising pivot means hingedly connecting said cap member to said fluid bed for pivoting said cap member relative to said fluid bed to afford the placement of components to be heat treated within said fluid bed.

16. A fluid bed furnace as defined in claim 15 wherein said pivot means comprises a cylindrical column carried by said fluid bed, a hollow cylindrical member carried by said cap member having a greater diameter than said cylindrical column, and wherein said cylindrical column is received by said hollow cylindrical member.

17. A fluid bed furnace as defined in claim 16 wherein said cap member bottom is slightly spaced from said fluid bed for providing clearance for the relative pivotal movement of said cap member, and wherein said hollow cylindrical member includes means for adjusting the spacing between said bottom of said cap member and said fluid bed.

* * * * *